US005318416A

United States Patent [19]

Hantschk et al.

[11] Patent Number: 5,318,416

[45] Date of Patent: Jun. 7, 1994

[54] CASING OF AN ECCENTRIC WORM PUMP DESIGNED TO BURST AT PRESELECTED PRESSURE

[75] Inventors: Günther Hantschk, Waldkraiburg; Jörg Eitler, Mettenheim-Hart; Johann Kreidl, Waldkraiburg, all of Fed. Rep. of Germany

[73] Assignee: Netzsch-Mohnopumpen GmbH, Waldkraiburg, Fed. Rep. of Germany

[21] Appl. No.: 965,278

[22] PCT Filed: May 21, 1992

[86] PCT No.: PCT/EP92/01139

§ 371 Date: Jan. 22, 1993

§ 102(e) Date: Jan. 22, 1993

[87] PCT Pub. No.: WO92/20923

PCT Pub. Date: Nov. 26, 1992

[30] Foreign Application Priority Data

May 22, 1991 [DE] Fed. Rep. of Germany ..... 4116697
Oct. 22, 1991 [DE] Fed. Rep. of Germany ..... 4134853

[51] Int. Cl.[5] ..... F04C 2/107; F04C 5/00; F42B 33/02

[52] U.S. Cl. ..... 418/48; 418/153; 86/31; 102/481

[58] Field of Search ..... 418/48, 153, 157, 178; 86/31, 33; 102/481

[56] References Cited

U.S. PATENT DOCUMENTS 3,084,631 4/1963 Bourke ..... 418/48
4,084,512 4/1978 San Miguel ..... 102/481
4,458,482 7/1984 Vetter et al. ..... 102/481
5,035,180 7/1991 Purcell et al. ..... 102/481

FOREIGN PATENT DOCUMENTS 0083829 7/1983 European Pat. Off. .
0255336 2/1988 European Pat. Off. .
0380050 8/1990 European Pat. Off. ..... 418/48
2311770 9/1974 Fed. Rep. of Germany .
2331173 9/1976 Fed. Rep. of Germany .
2618038 11/1977 Fed. Rep. of Germany .
2718120 11/1978 Fed. Rep. of Germany .
2527141 4/1981 Fed. Rep. of Germany .
3218714 2/1986 Fed. Rep. of Germany .
3438379 4/1986 Fed. Rep. of Germany ..... 418/48
3525529 8/1986 Fed. Rep. of Germany .
3641855 6/1988 Fed. Rep. of Germany ..... 418/48
2021199 11/1979 United Kingdom .

*Primary Examiner*—John J. Vrablik
*Attorney, Agent, or Firm*—Kenyon & Kenyon

[57] ABSTRACT

A stator jacket (12) and a stator lining (22) of elastomeric material together form a tubular pump stator (10) the ends (20) of which are connected to a connecting piece (36) of a casing portion (32, 34) each. The stator jacket (12) has at least one parting area (14) extending throughout its length. This and the region of the stator lining (22) located radially inside thereof as well as the junctions of the connecting pieces (36) with the stator jacket (12) are designed such that the pump stator (10) will burst in at least one parting area (14, 16) when a predetermined positive internal pressure is exceeded. This provides pressure relief before a risk of explosion can develop when explosives are being conveyed.

10 Claims, 7 Drawing Sheets

CASING OF AN ECCENTRIC WORM PUMP DESIGNED TO BURST AT PRESELECTED PRESSURE

The invention relates to a casing of an eccentric worm pump, comprising a stator jacket which has at least one parting area extending throughout its length, a stator lining of elastomeric material forming a tubular pump stator together with the stator jacket, two casing portions, each connected by a connecting piece, with which they are formed, to a respective end of the stator jacket.

A readjustable stator for eccentric pumps is known from DE 32 18 714 C2, comprising a stator jacket made of metal or the like and an elastically deformable stator lining. The stator jacket is provided with a plurality of corrugations which are distributed around its circumference, extend in longitudinal direction of the stator, and have a radially inwardly projecting cross section with a preset breaking point. For compensation of the stator lining wear, the diameter of this known stator can be reduced by tightening a collar or clamping ring which acts on it from outside. The corrugations in the stator jacket facilitate the tightening from the very beginning and are intended to permit stronger tightening by rupturing at their preset breaking points, whereby the stator jacket is subdivided into independent jacket segments so that no further deformation work must be accomplished at the corrugations upon further tightening.

Stators of eccentric worm pumps usually are arranged between two casing portions interconnected by flanges screwed together or by tie bolts, and they each include a connecting piece extending over a respective one of the ends of the stator jacket. Such arrangements are known from DE 23 31 173 C3 and DE 25 27 141 C3 also with readjustable stators.

Eccentric worm pumps, in principle, are suited very well for conveying explosive emulsions. And yet an operating error or special circumstances may lead to pressure and temperature conditions liable to initiate an explosion within such a pump.

Such an explosion begins by an ignition process released by the supply of energy. The ignited explosive develops gases which cause the pressure to rise, thereby further accelerating the combustion speed. Modern explosives containing water—slurries or emulsions—do not burn at normal atmospheric pressure (1 bar). The minimum pressure for automatic combustion is between 5 and 20 bars, depending on the composition of a typical explosive on an hydrous base. Tests have shown that, when ignited under pressure by a short, glowing wire (point ignition), a closed container filled with an emulsion explosive does not detonate if the container is protected by a rupture disc. Such a rupture disc, however, cannot prevent detonation if the ignition takes place at many points at the same time because in that event the safety disc, with its relatively small cross section, cannot reduce the pressure build-up fast enough.

Simultaneous ignition at a number of points can occur in an eccentric worm pump if the latter is working for an extended period of time against a plugged or closed outlet. In that case the full drive energy is converted into thermal energy which will heat up the material in the conveying chambers of the pump between rotor and stator. When the temperature rises high enough spontaneous ignitions sets in at various places in the explosive. The critical time frame for such heating typically is from five to twenty minutes. The time of transition from quick combustion (deflagration) to detonation in the conveying chambers depends on the quantity of explosive which autoignites at the same time, and may lie between milliseconds and seconds.

It is, therefore, the object of the invention to provide for pressure relief in an eccentric worm pump before a critical pressure potential is reached which may result in the explosion of an explosive being conveyed, said pressure relief taking place faster than the further pressure rise which is possible with a given drive performance and design of the pump.

The known readjustable stators for eccentric pumps neither are provided to solve this problem nor are they suitable to do so. The devices disposed all around the stator jacket for readjustment, such as clamping rings, resist any enlargement of the stator diameter even if rated rupture locations provided at the stator jacket have broken already or the stator jacket is divided from the beginning into a plurality of independently adjustable, shell-like segments. Moreover, in general, the stator lining radially inside the separating zones provided in the stator jacket for tightening purposes is much too thick to be able to burst in time under the influence of dangerously high positive internal pressure. The state of the art of adjustable stators discussed above thus provides no starting base for the solution of the problem posed.

DE 27 18 120 A1 discloses a piston pump for conveying low-stability fluids, especially explosive fluids. It comprises two cylinders which are arranged side by side and in which a pump piston each and an engine piston adapted to be driven by compressed air are disposed axially one behind the other and guided telescopically inside each other. During normal operation, relative shifting between the pump piston and the engine piston is prevented by radial shear pins. Yet the shear pins are sheared between a pump piston and the corresponding engine piston when the pressure of the fluid being conveyed surpasses a certain limit. The pump piston, therefore, is displaced partly into the engine piston, whereby the volume of the cylinder space it defines is enlarged until, finally, radial outlet ports in the cylinder are opened so that the flow medium can pass out through them.

Starting from a casing of the kind specified initially, the object is met, according to the invention, in that at least one parting area of the stator jacket and the region of the stator lining located radially inside thereof as well as the junctions of the connecting pieces with the stator jacket are designed such that the pump stator will burst in at least one parting area when a predetermined positive internal pressure is exceeded.

The invention is applicable with particular advantage in a casing for an eccentric worm pump with which the stator lining comprises a double-thread internal thread surface having profile sections which are arcuate in cross section and include an apex each. In accordance with the invention at least one parting area of the stator jacket extends along an apex at a pitch which corresponds to the thread pitch of the internal thread surface of the stator lining.

The stator jacket preferably is divided along two parting areas into two substantially rigid jacket sections. This has the advantage that the burst forces generated during the rise in pressure are concentrated in two parting areas so that upon bursting of the stator jacket also the stator lining in the parting areas is rapidly loaded beyond the limit of its tensile strength thus being forced to burst.

The two jacket portions can be held together by clamping members which are disposed transversely and each include a rated rupture location.

The stator preferably is connected to both associated casing portions by the fact that the stator jacket has two annular ends by which it encompasses one each of the two casing portions. This departure from the customary connection between the ends of the stator jacket and the associated connecting pieces has the advantage that the stator jacket can break apart all the way to both its ends without being hampered by form lock of the connecting pieces.

In order to achieve the slightest possible obstruction by friction lock as well when the stator jacket splits open to its ends, it is further convenient to have the two casing portions kept at a certain distance from each other by spacer bolts and to guide the ends of the stator jacket so that they float axially on the connecting pieces.

The parting areas in the stator jacket and in the stator lining preferably are dimensioned such that the positive internal pressure at which the pump stator will burst lies from 5 to 10 bars above the operating excess pressure of the pump.

Preferably the stator jacket is made of a material whose elongation at break is 1.0% at the most. Materials of that nature, for instance, are gray cast iron having a normal elongation at break of from 0.3 to 0.8% and ceramic materials having a normal elongation at break of from 0.1 to 0.2% and certain types of glass.

If the stator lining is to have a substantially constant thickness the stator jacket itself must form an internal thread surface. If such a stator jacket has the outer shape of a circular cylinder, it will be rather rigid in the zones between two helical outer grooves each so that considerable internal pressure is needed to cause the stator to split open along the helical grooves. Additional paraxial grooves of constant depth formed from outside in such a stator jacket can only inessentially reduce the rigidity of those portions of the stator jacket which are defined by two helical grooves each. For this reason they cannot actually contribute all too much to the desired safety against explosion.

To further increase the safety against explosion of an eccentric worm pump comprising such a stator jacket, it is provided according to the invention that the parting areas of the stator jacket are defined radially inwardly by an inner paraxial groove each. The depth of the groove measured from the stator axis is at least approximately constant.

It is not particularly difficult to produce such inner paraxial grooves with very small tolerances in depth by applying conventional manufacturing methods, such as broaching or slotting. Thus the thickness of the parting areas of the stator jacket which remain radially outwardly of the paraxial inner grooves can be adapted closely to the particular requirements, provided the outer surface of the stator jacket has small tolerances in diameter and roundness.

If that condition should not be fulfilled or if the stator jacket should have an especially tough outer skin it is convenient for the stator jacket to have a respective outer paraxial groove located radially opposite each inner paraxial groove.

In any case it is advantageous if the inner grooves have a sharp-edge groove base profile. That produces notch tensions which let the stator jacket burst especially quickly in the event of critical internal excess pressure.

The embodiment which includes the outer and inner grooves in parallel with the axis can be developed further in that the outer paraxial grooves have a tapering profile which converges toward the groove base, while the groove base profile of the inner paraxial grooves is rectangular and symmetrical with respect to the associated outer groove.

The inner paraxial grooves may be filled with the elastomer which formes the stator lining. In this manner the anchoring of the stator lining in the stator jacket is improved.

However, it is convenient if the elastomer of the stator lining is not vulcanized to the walls of the inner paraxial grooves. That can be accomplished readily by simply not applying the bonding promoter needed for vulcanizing the stator lining to the stator jacket in the paraxial inner grooves.

Embodiments of the invention will be described in greater detail below, with reference to diagrammatic drawings, in which.

Figure 9:
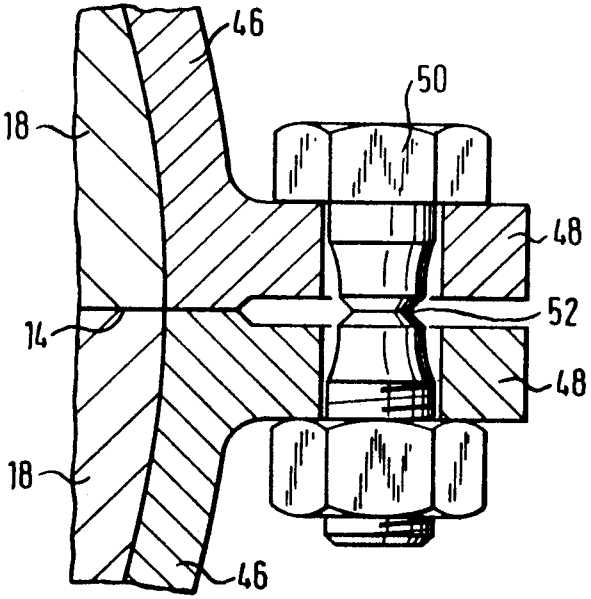
Figure 8:
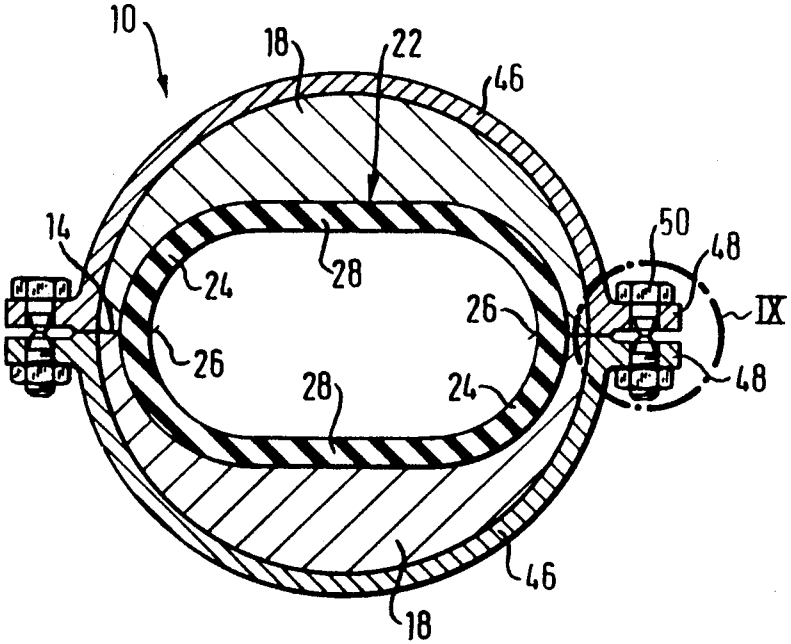
FIG. 8 shows the cross section VIII—VIII of FIG. 7.
Figure 10:
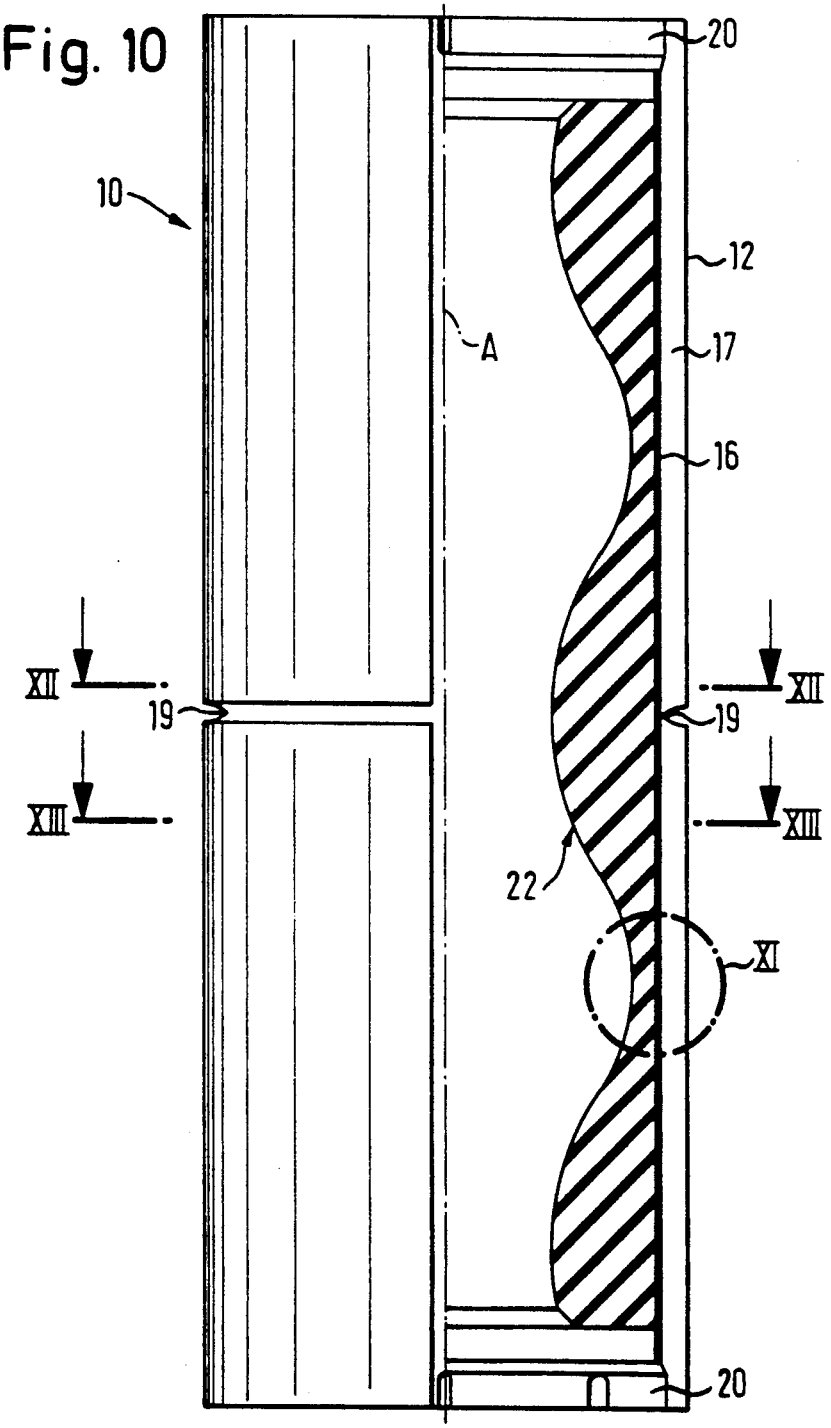
Figure 11:
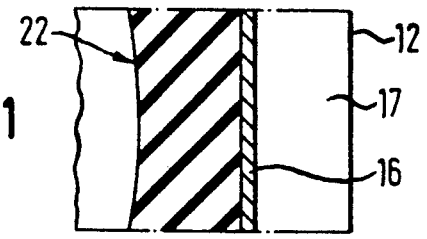
Figure 12:
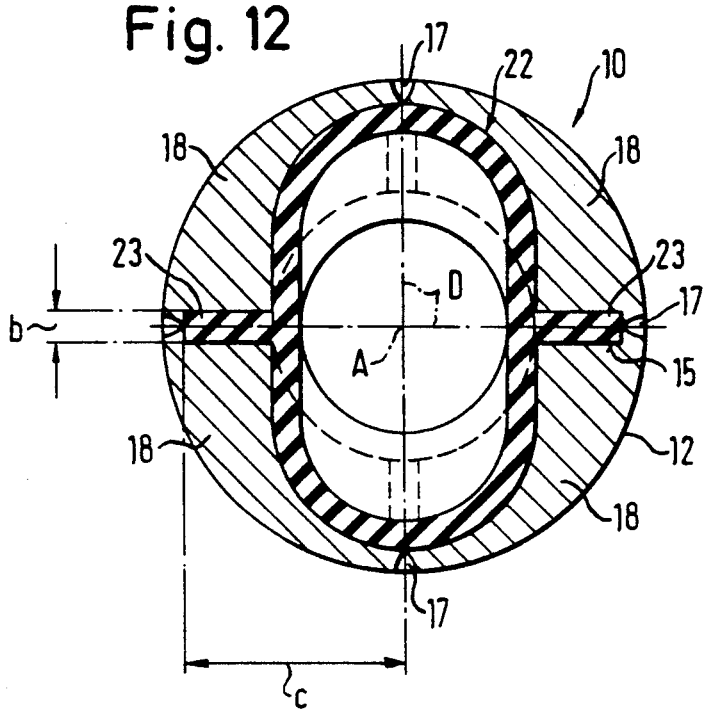

FIG. 9 presents the enlarged cutout in the area IX—IX of FIG. 8;

FIG. 10 is a side elevation, with one half shown in axial section, of a pump stator;

FIG. 11 presents the cutout XI of FIG. 10 on an enlarged scale;

FIG. 12 shows the cross section XII—XII of FIG. 10, and

Figure 13:
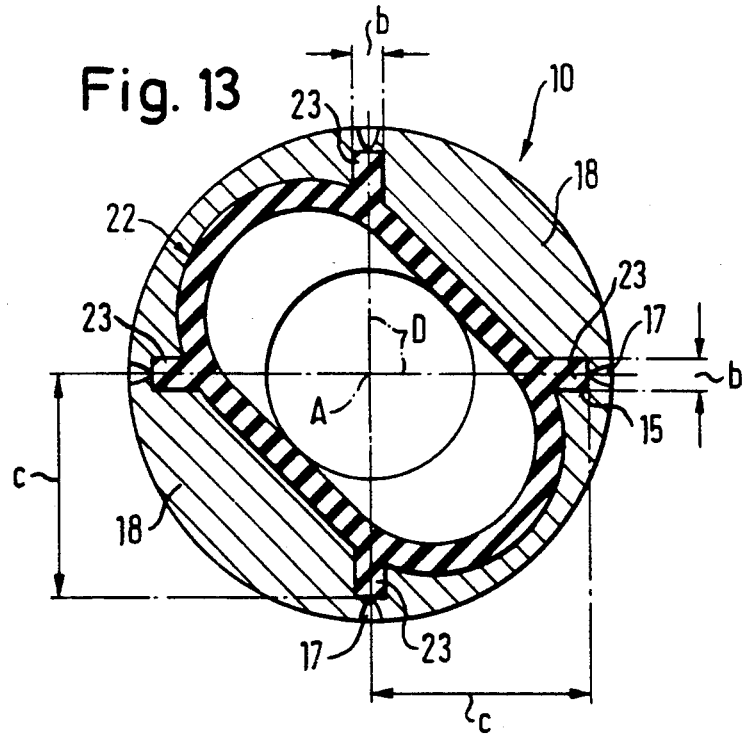

FIG. 13 shows the cross section XIII—XIII of FIG. 10.

Figure 1:
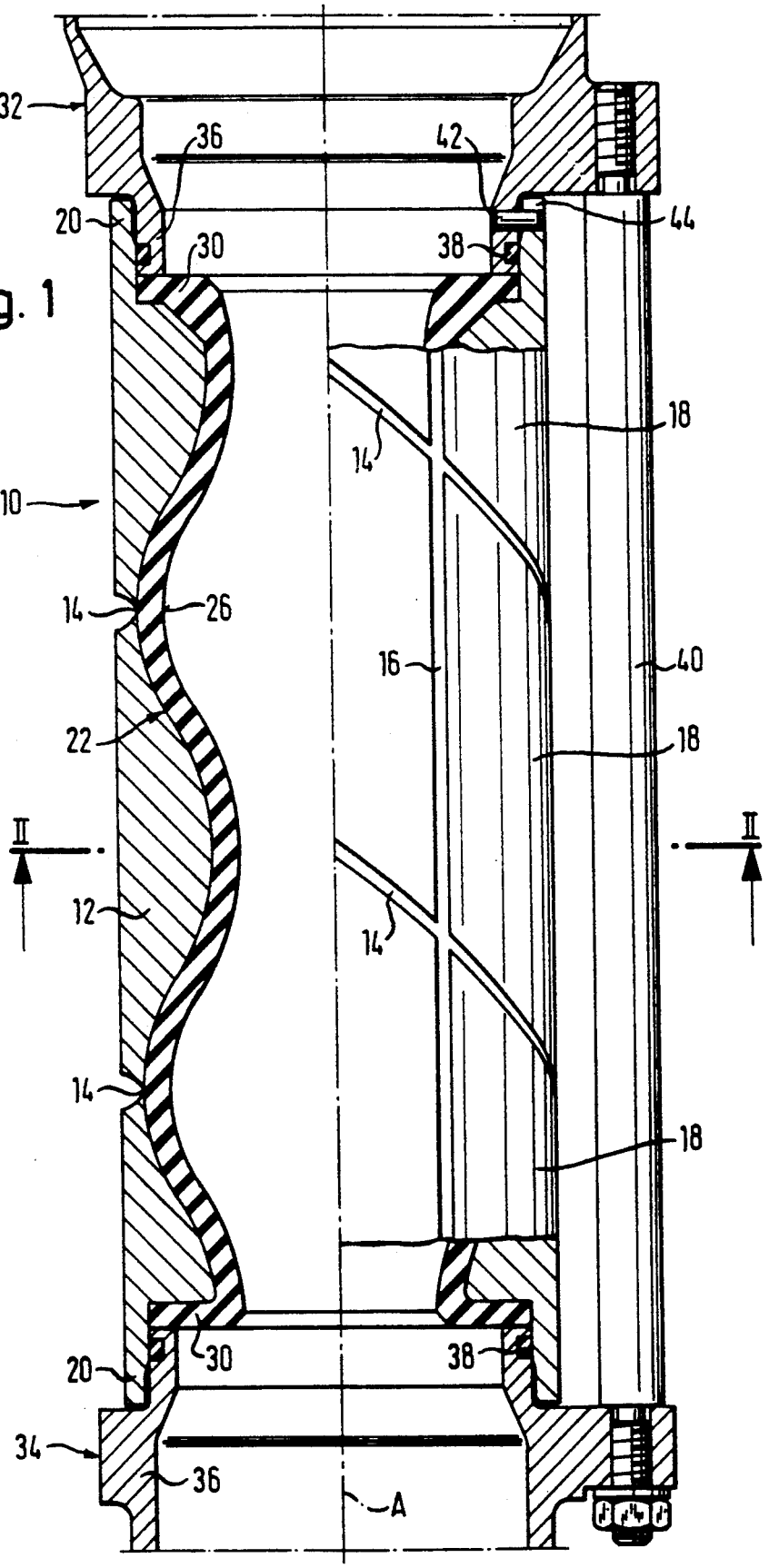
FIG. 1 is an axial sectional view of a pump stator and adjacent casing parts of an eccentric worm pump.

The eccentric worm pump partly shown in FIG. 1 is designed for an operating excess pressure (above ambient pressure) of 20 bars. It comprises a pump stator 10 having a stator jacket 12 which is made of gray cast iron and formed with rated rupture locations embodied by helical parting areas 14 and paraxial parting areas 16. In the parting areas 14 and 16 the radial thickness of the stator jacket 12 is reduced by a groove each, formed from outside, such as by casting or milling so that the stator jacket will burst at an internal positive pressure in the order of magnitude of from 5 to 10 bars above the operating excess pressure. The stator jacket 12 has two annular ends 20 which likewise burst at the same positive pressure at the inside.

A rubber-elastic stator lining 22 is secured in the stator jacket 12, preferably by vulcanizing. The stator lining 22 forms a double thread composed in cross section over the whole length of the stator lining of two arcuate profile sections 24, each having an apex 26, and of two intermediate straight profile sections 28. The stator lining 22 includes two flange-like end portions 30 which extend into one of the annular ends 20 of the stator jacket 12.

The pump stator 10 thus designed is arranged between two rigid casing portions 32 and 34 which each comprise a connecting piece 36. The two connecting pieces 36 engage in a respective one of the annular ends 20 of the stator jacket 12 so as to be surrounded by the same. An annular seal 38 is embedded in the outer jacket surface of each connecting piece 36 to establish sealing with the inner jacket surface of the associated annular end 20 of the stator jacket 12.

The two casing portions 32 and 34 are interconnected by a plurality of spacer bolts 40 which extend parallel to the axis A of the pump stator 10 and keep the casing portions at such a distance from each other that the stator jacket 12 is given minor axial clearance, in other words not clamped between the casing portions 32 and 34. Each of the two connecting pieces 36 should only loosely contact the respective one of the flange-like end portions 30 of the stator lining 22, if at all.

A radial pin 42 fixed in the connecting piece 36 of the upper casing portion 32 in FIG. 1 engages in a paraxial slot 44 in the upper end 20 of the stator jacket 12, thus preventing the same from rotating.

Figure 3:
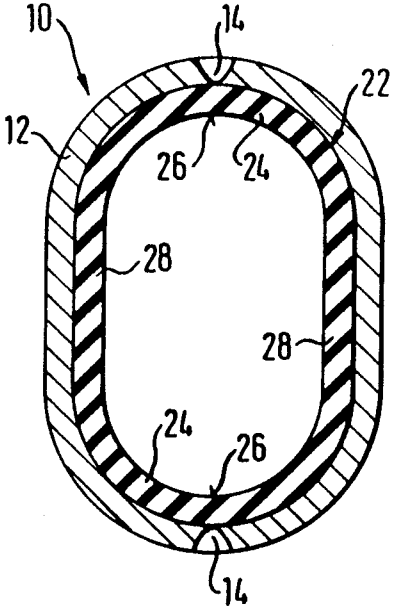
Figure 2:
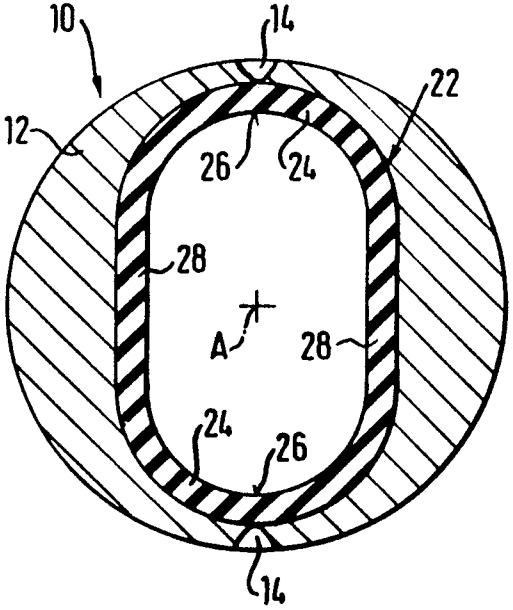
FIG. 2 shows the cross section II—II of FIG. 1.

According to FIG. 2, the stator jacket 12 has a circular outer contour in cross section which is especially well suited for producing the stator jacket by a casting process. Instead, the stator jacket also may be cast with the oval cross section shown in FIG. 3. Elliptical cross sectional shapes are conceivable as well which would be between the circular and oval configurations.

Figure 4:
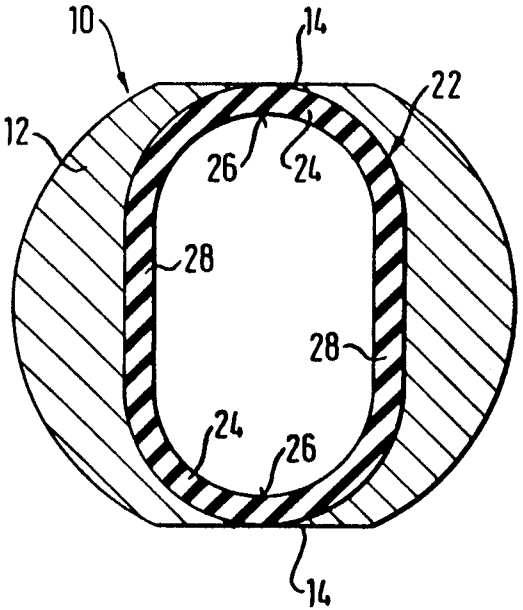
FIGS. 3 to 6 illustrate modified cross sectional shapes.

As an alternative to the groove-like shapes of FIGS. 1 to 3 and 5 and 6, the helical parting areas 14 of the stator jacket which follow the apices 26 of the stator lining 22 also may be formed by flattened zones, as illustrated in FIG. 4.

As shown in FIGS. 1 to 4 and 7 and 8, the stator lining 22 is of constant thickness throughout its entire circumference and essentially also over its full length, the thickness being so small that the stator lining will burst in the areas radially inside the parting areas 14 and also 16, if desired, formed in the stator jacket 12 when the stator jacket 12 itself bursts in these parting areas under the positive internal pressure.

Figure 5:
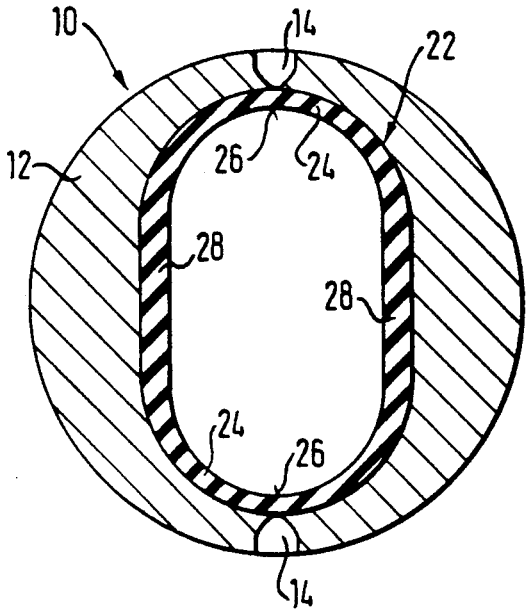
Figure 6:
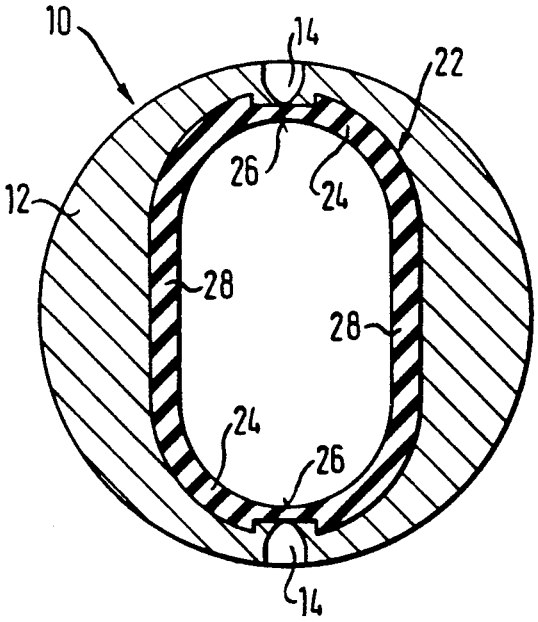

In the case of FIGS. 5 and 6, on the other hand, also the stator lining 22 is weakened in its regions radially inside the parting areas 14 by having a reduced thickness in these regions. The reduction in thickness may follow a steady course, as shown in FIG. 5, or it may be obtained by the stator jacket 12 protruding radially inwardly in the area of the apices 26.

A reduction in thickness of steady course also may be obtained in the manner known per se from DE 35 25 529 C1 by the inner and outer contours of the stator lining 22 being geometrically similar ovals which, however, are rotated with respect to each other through a small angle of, for example, 5° to 25°.

Figure 7:
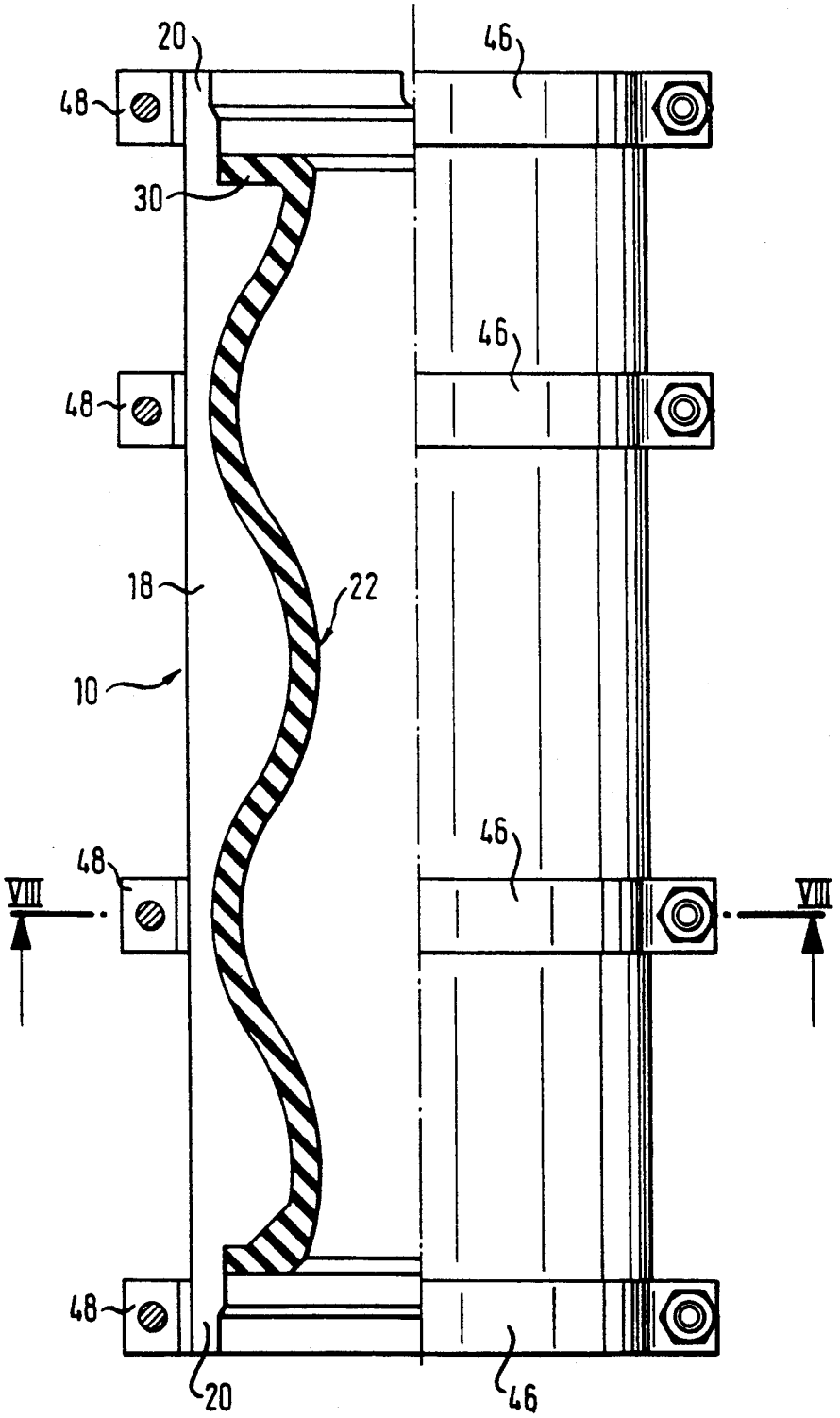
FIG. 7 shows another pump stator of an eccentric worm pump.

While FIGS. 1 to 6 show the parting areas 14 and also the parting areas 16, where provided, to be zones in which the stator jacket 12 is reduced in thickness and thus weakened, according to FIGS. 7 to 9 the parting areas 14 also may be areas in which halves of the stator jacket 12 separated from the beginning abut each other and are held together by clamping means. In the case of the embodiment illustrated in FIGS. 7 to 9 the clamping means are embodied by clamping rings 46 which comprise flanges 48 and by associated tightening screws 50. Each tightening screw 50 is formed with a rated rupture location 52. Instead of being formed at clamping rings 46, the flanges 48 also may be formed directly at the two halves of the stator jacket 12, for instance by casting.

The pump stator 10 illustrated in FIGS. 10 to 13 belongs to an eccentric worm pump which is designed for an operating excess pressure of 20 bars, for example. When this pressure is exceeded the pump stator 10 should burst. The pump stator 10 has a stator jacket 12 which is of circular cylindrical outer shape, thereby defining a stator axis A, while it has the configuration of a double helix at its inside.

Four inner grooves 15 of constant width b and constant depth c, measured from the stator axis A, are formed in the stator jacket 12. They each have a central plane D which includes the stator axis A as well as two sidewalls in parallel with the same. They are referred to as inner paraxial grooves. These grooves 15 are offset by 90° with respect to each other, thus being disposed in pairs diametrically opposite each other. The depth c of the inner paraxial grooves 15 is dimensioned such that these grooves define parting areas 16 in which the stator jacket 12 will split along at least one of these grooves when there is a critical positive internal pressure and will deform along the other inner paraxial grooves at least to such a degree that the excess pressure at the inside is reduced abruptly.

An outer paraxial groove 17 is provided in addition in each parting area 16 so as to interrupt the possibly tough outer skin of the stator jacket 12 and render harmless any inaccuracies in the outer dimensions of the stator jacket. In the embodiment shown, the outer paraxial grooves 17 have a triangular outline with the apex lying in the central plane D of the corresponding inner paraxial groove 15.

When the outer paraxial grooves 17 are formed, their depth as well as the depth c of the inner paraxial grooves 15 is referred to the stator axis A rather than the outside surface of the stator jacket in order to make sure that the stator jacket 12 will disassemble instantly into four like jacket portions 18 as soon as the critical internal excess pressure is exceeded. In this manner it is warranted that each individual parting area 16 will have a radial thickness which is highly uniform for the entire length thereof and which also is the same with a high degree of accuracy in all four parting areas 16.

As shown in FIG. 10, the stator jacket 12 may comprise one or more outer annular grooves 19 in order for the separating jacket portions 18, in the event of bursting, to become divided into smaller pieces, which then will be harmless to the surroundings, or at least for them to absorb some additional energy by way of deformation work.

Finally, the stator jacket 12 has two annular ends 20 which, when installed, each enclose one connecting piece in a way so as to be easily separated from the same in radial outward direction in case of a burst. The connecting pieces belong to casing portions not shown between which the pump stator 10 is mounted. Reference is made to FIG. 1 for details of this arrangement.

A rubber-elastic stator lining 22 is attached in the stator jacket 12, preferably by vulcanizing. The stator lining 22 is of constant thickness in all cross sections through the pump stator 10, i.e. it forms a double internal thread just like the inner surface of the stator jacket 12, a single-thread rotor (not shown) being associated with the same, as is usual with eccentric worm pumps.

During the vulcanization, the rubber or elastomeric material of which the stator lining 22 is made has filled in the inner paraxial grooves 15 and consequently presents fins 23 of the same rectangular cross section as these grooves. However, in contrast to the stator lining 22 itself the fins 23 should not adhere to the stator jacket 12 or do so only with negligibly small force. For this reason the grooves 15 have not been coated with a bond promoter prior to the application of the rubber or elastomeric material, in contrast to the surface of the stator jacket 12 which lies against the stator lining 22 proper.

Parting areas 16 of the kind described above may be provided in eccentric worm type machines of any kind, for instance also in pumps or engines whose stator presents a triple or multiple internal thread surface.

What is claimed is:

1. A casing of an eccentric worm pump, comprising
a stator jacket which has at least one parting area extending throughout its length,
a stator lining of elastomeric material forming a tubular pump stator together with the stator jacket,
two casing portions each connected by a connecting piece, with which they are formed, to a respective end of the stator jacket, wherein at least one parting area of the stator jacket and the region of the stator lining located radially inside thereof as well as the junctions of the connecting pieces with the stator jacket are designed such that the pump stator will burst in at least one parting area when a preselected positive internal pressure is exceeded.

2. The casing as claimed in claim 1, wherein
the stator lining comprises a double-thread internal thread surface having profile sections which are arcuate in cross section and include an apex each, and
at least one parting area of the stator jacket extends along one of the apices at a pitch which corresponds to the thread pitch of the internal thread surface of the stator lining.

3. The casing as claimed in claim 2, wherein
the stator jacket is divided along two parting areas into two substantially rigid jacket portions, and
the two jacket portions are held together by clamping members which are disposed transversely and each include a rated rupture location.

4. The casing as claimed in any one of claims 1 to 3, wherein the stator jacket has two annular ends by which it surrounds the connecting piece of one each of the casing portions.

5. The casing as claimed in claim 4, wherein the two casing portions are kept at a certain distance from each other by spacer bolts and the ends of the stator jacket are guided to float axially on the connecting pieces.

6. A casing of an eccentric worm pump, comprising
a stator jacket which is substantially of the shape of a circular cylinder on the outside and of helical shape at the inside and which is formed with parting areas by paraxial grooves,
a stator lining of elastomeric material forming a tubular pump stator together with the stator jacket, and
two casing portions, each connected to a respective end of the stator jacket,
the parting areas of the stator jacket and the region of the stator lining located radially inside thereof as well as the junctions of the casing portions with the stator jacket being designed such that the pump stator will burst in at least one parting area when a preselected positive internal pressure is exceeded, wherein the parting areas of the stator jacket are defined radially inwardly by an inner paraxial groove each having a depth, measured from the stator axis, which is at least approximately constant.

7. The casing as claimed in claim 6, wherein the stator jacket includes a respective outer paraxial groove radially opposite each inner paraxial groove.

8. The casing as claimed in claim 7, wherein the outer paraxial grooves have an outline which tapers towards their groove base and the groove base outline of the inner paraxial grooves is rectangular and symmetrical with respect to the associated outer groove.

9. The casing as claimed in any one of claim 6 to 8, wherein the inner paraxial grooves are filled with the elastomer which forms the stator 10. The casing as claimed in claim 9, wherein the elastomer of the stator lining is not vulcanized to the walls of the inner paraxial grooves.

* * * * *

UNITED STATES PATENT AND TRADEMARK OFFICE

CERTIFICATE OF CORRECTION

PATENT NO. : 5,318,416

DATED : June 7, 1994

INVENTOR(S) : HANTSCHK, G. et al.

It is certified that error appears in the above-indentified patent and that said Letters Patent is hereby corrected as shown below:

In Column 5, line 54, change "25°" to -- 15° --;

In Column 8, line 36, change "claim" to -- claims --;

line 38, change "stator" to -- stator lining. --.

Signed and Sealed this

Twenty-eight Day of February, 1995

241033

*Attest:*

*Attesting Officer*

BRUCE LEHMAN

*Commissioner of Patents and Trademarks*